US006741157B2

(12) United States Patent
Chen

(10) Patent No.: US 6,741,157 B2
(45) Date of Patent: May 25, 2004

(54) ELECTRICAL SWITCH WITH CIRCUIT BREAKER

(76) Inventor: Jack Chen, 14 Kimberly Cir., Oak Brook, IL (US) 60521

( * ) Notice: Subject to any disclaimer, the term of this patent is extended or adjusted under 35 U.S.C. 154(b) by 0 days.

(21) Appl. No.: 10/241,190

(22) Filed: Sep. 11, 2002

(65) Prior Publication Data

US 2004/0046635 A1 Mar. 11, 2004

(51) Int. Cl.[7] ..... H01H 37/52

(52) U.S. Cl. ..... 337/59; 337/37; 337/56; 337/85

(58) Field of Search ..... 337/59, 37, 77, 337/53, 55, 56, 66, 72, 85, 89, 91, 79

(56) References Cited

U.S. PATENT DOCUMENTS 1,952,129 A * 3/1934 Hardman ..... 337/348
2,262,205 A * 11/1941 Schachtner ..... 337/55
2,911,503 A * 11/1959 Garbers ..... 337/56
4,510,479 A * 4/1985 Merchant ..... 337/91
4,803,455 A 2/1989 Kuczynski
4,833,439 A 5/1989 Bowden
4,868,535 A 9/1989 Janniere
5,453,725 A 9/1995 You
5,541,569 A 7/1996 Jang

* cited by examiner

*Primary Examiner*—Anatoly Vortman
(74) *Attorney, Agent, or Firm*—Robert L. Marsh

(57) ABSTRACT

An electric switch having a circuit breaker includes a manually operable actuator that moves one contact between a first and a second position. A bimetal member moves another contact between a first and a second position in response to an electric current above a given threshold passing therethrough, and the movement of this contact to the second position releases a catch that retains a spring loaded indicator in its retracted position. The two contacts abut one another closing the circuit when both contacts are in their first positions. An excessive current will therefore break the circuit and release the indicator to move to the extended position. The releasable catch resets after the bimetal member has cooled and it will again retain the indicator in the retracted position when it is subsequently manually depressed.

9 Claims, 3 Drawing Sheets

ELECTRICAL SWITCH WITH CIRCUIT BREAKER

The present invention relates to electric switches of the type used to energize or de-energize an electric appliance, and in particular to an electric switch having incorporated therein a circuit breaker for de-energizing the appliance in the event of an overload.

BACKGROUND OF THE INVENTION

An electric appliance such as a vacuum cleaner or the like powered by conventional AC current is energized or de-energized by actuating a thumb-operated switched. The circuit for an appliance includes an electric motor which may become impaired by an object that obstructs the rotation of the motor. In such an event, the motor will draw an excess of current which if allowed to continue will cause damage to the circuitry of the motor or other components of the appliance. To prevent such an overload, it is desirable that the appliance include a circuit breaker which can be easily reset by the operator.

A switch incorporating a built-in circuit breaker is disclosed by Jang, U.S. Pat. No. 5,541,569. The circuit breaker of Jang includes a pivotable switch member for opening and closing the contacts of the switch, and a circuit of the switch includes a bimetal actuator. In normal operation, a contact on the bimetal actuator extends through a hole in a generally planar indicator member that is urged by a spring to an extended position. The indicator member is retained in the retracted position by the contact on the bimetal actuator that extends through the hole and abuts a second contact on the opposite side of the indicator member. In the event of an overload, the bimetal actuator causes the contact attached thereto to be retracted through the hole, thereby allowing the insulated indicator to move to the extended position. A portion of the insulated indicator then becomes wedged between the contact on the bimetal actuator and the second contact on the opposite side of the actuator thereby retaining the circuit open until the bimetal actuator is manually depressed by the operator.

An appliance such as a vacuum cleaner must be manufactured to operate on a daily basis for a number of years. During the course of the normal life of the appliance, a circuit breaker incorporated into the switch may be called into operation several hundred times. The repeated movement of the actuator erodes away the portion of the insulating material wedged between the two contacts. After a given number of uses the portion of an insulating member that has been repeatedly wedged between spring loaded contacts may become so worn away that the circuit breaker will fail to operate when called upon. It would be desirable, therefore, to provide an improved switch with an incorporated circuit breaker that does not rely upon interposing an insulating member between spring loaded contacts.

SUMMARY OF THE INVENTION

Briefly, the present invention is embodied in an electric switch for completing a circuit having a circuit breaker therein where the switch includes a manually operated actuator, a first contact, a second contact, the first contact moveable between a first position and a second position in response to an excessive current, and the second contact moveable between a first orientation and a second orientation in response to movement of the actuator. The switch includes a bimetal member and means for joining the first contact to the bimetal member wherein the first contact is moved from the first position to the second position in response to an electric current above a given threshold.

The second contact is moveable between the first orientation and the second orientation in response to movement of the actuator. In normal operation, the first contact is in an abutting relationship with the second contact when the second contact is in the first orientation and the first contact is in the first position and the contacts are spaced from one another when the first contact is in the second position, and are also spaced from one another when the second contact is in the second orientation.

The switch further includes an indicator that is moveable between an extended position indicative of a broken circuit and a retracted position indicative of a closed circuit, and means, such as a spring, for urging the indicator towards the extended position. A catch releasably retains the indicator in the retracted position. A means for releasing the catch is responsive to the movement of the first contact to the second position. The indicator also has means thereon for retaining the second contact in its second position while the indicator is in the extended position.

An operator will manually operate the actuator to turn the appliance on, thereby moving the second contact from its second orientation to its first orientation where it will abut the first contact and close the circuit. In the event of an overload in which the current exceeds the threshold as determined by the bimetal member, the bimetal member will cause movement of the first contact from its first position to its second position where it is spaced from the second contact thereby breaking the circuit. The same movement that breaks the circuit releases the spring loaded overload indicator, allowing it to be moved by the spring to the extended position. The movement of the indicator to the extended position will also lock the first contact in the second position thereby preventing the closing of the circuit after the bimetal member cools.

After an operator has checked the device and remedied the cause of the overload, the indicator can be manually depressed, returning it to the retracted position where it can again be engaged by the means for retaining. Once the indicator has been reset, the bimetal member can move the first contact back to its first position, thereby resetting the circuit breaker.

The invention further includes a first connector electrically connected to the first contact and a second contact electrically connected to the second contact. A third connector connects to a circuit for operating a lamp in the actuator, the lamp being illuminated when the actuator is in the on orientation and not illuminated when the actuator is in the off orientation. The lamp circuit includes the second connector, the third connector, and a switch operated by the actuator that is closed when the second contact is in the first orientation and opened when the second contact is in the second orientation.

BRIEF DESCRIPTION OF THE DRAWINGS

A better understanding of the invention will be had after a reading of the following detailed description taken in conjunction with the drawings in which.

DETAILED DESCRIPTION OF A PREFERRED EMBODIMENT

Figure 2:
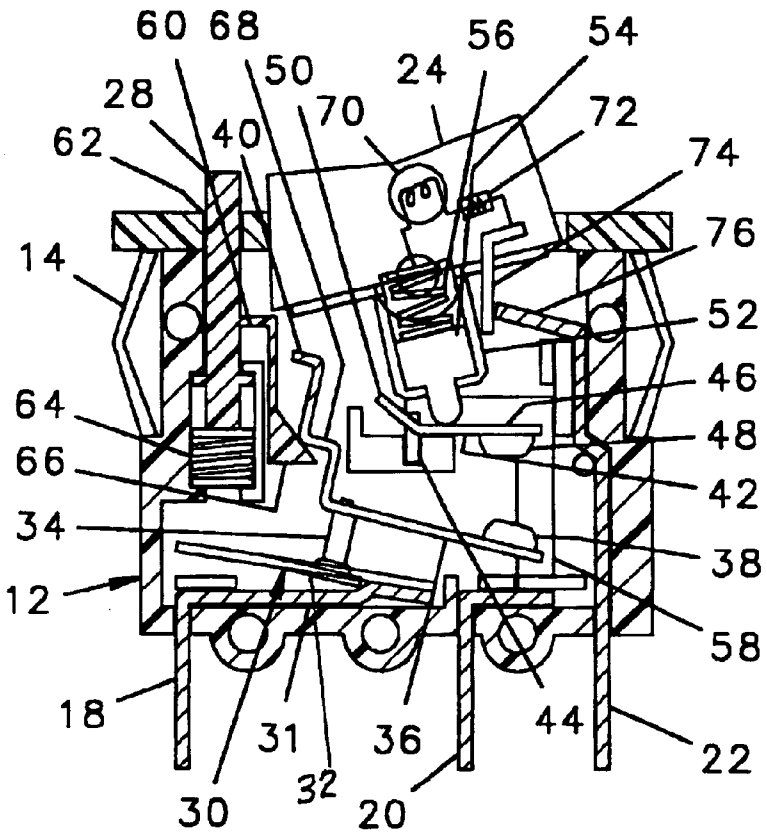
FIG. 2 is a cross-sectional view of the switch of FIG. 1 in which the circuit breaker has been opened.
Figure 1:
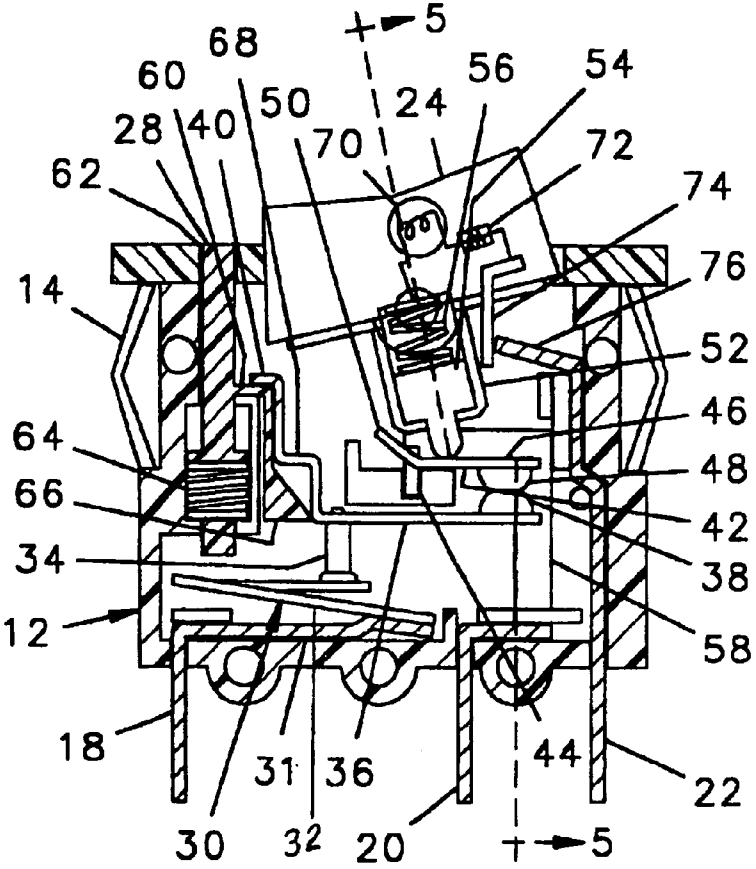
FIG. 1 is a cross-sectional view of a switch in accordance with the present invention in which the switch is closed and the circuit breaker is also closed.
Figure 4:
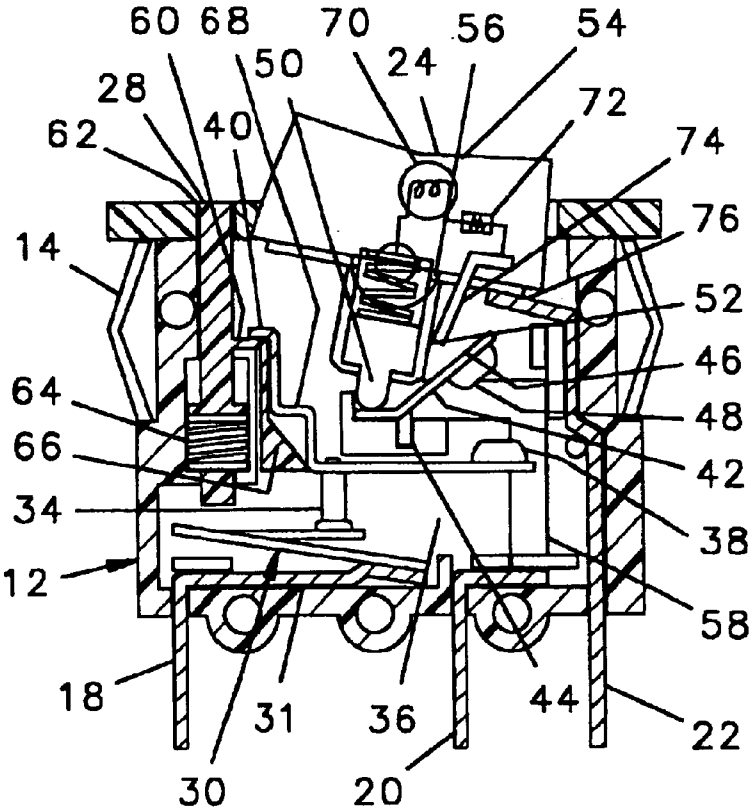
FIG. 4 is a cross-sectional view of the switch of FIG. 1 with the actuator opened and the circuit breaker in the closed position.
Figure 3:
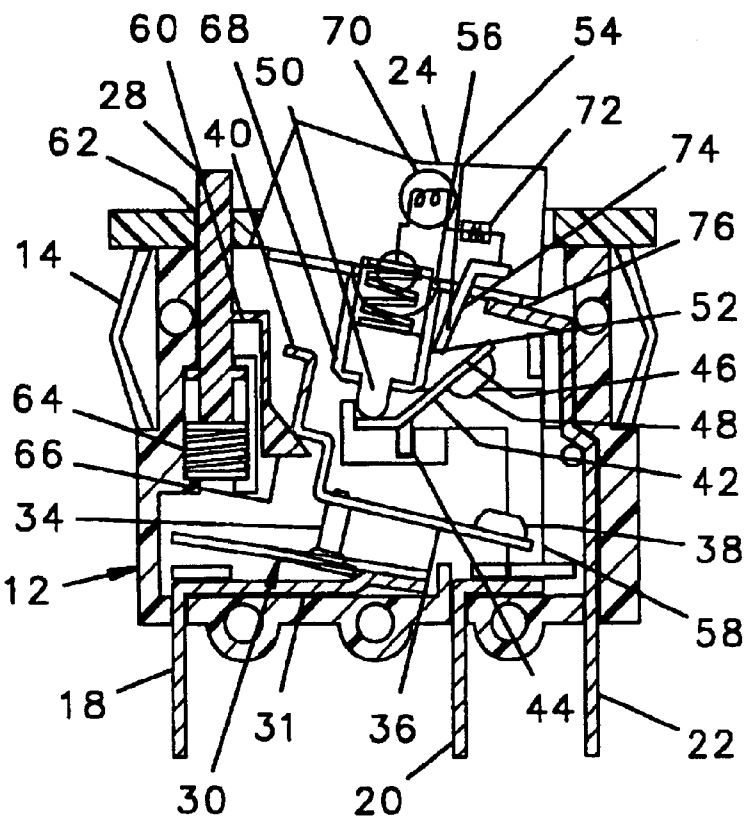
FIG. 3 is a cross-sectional view of the switch in FIG. 1 with the actuator opened and the circuit breaker also open.

Referring to FIGS. 1–5 a switch 10 in accordance with the present invention includes a housing 12 made of a suitable insulating material such as plastic. The switch is retained within a retaining aperture of an appliance by spring loaded members 14, 16 on opposite sides of the housing 12 and is connected into the circuit of the appliance by a first connector 18, a second connector 20, and a third connector 22. The switch 10 is opened and closed by an actuator 24 that pivots on a axis defined by pivot pins 26, 27 rotatable in journals 25, 29. The switch 10 further includes a circuit breaker indicator 28 that is in a recessed position, as shown in FIGS. 1 and 4, when the circuit of the breaker is closed, and is in an extended position, as shown in FIGS. 2 and 3, when the circuit of the breaker is open.

The switch 10 includes a bimetal member 30 having a base portion 32 electrically connected by connector bar 31 to the first connector 18 and a displaceable portion 34 connected to a transverse first contact retainer 36. The first contact retainer 36 has a first contact 38 on one end thereof, and a hook 40 at the opposite end thereof, the hook 40 operating as a catch to retain the indicator 28 in its retracted position as is further described below. When the current passing through the bimetal member 30 does not exceed a threshold amount and the indicator 28 is in the retracted position, the first contact retainer 36 will be in the orientation shown in FIGS. 1 and 4.

The switch 10 further includes an elongate second contact retainer 42 pivotable about a pivot 44. The second contact retainer 42 includes a first arm 46 at the distal end of which is a second contact 48 and a second arm 50 at an angle of about 135 degrees with respect to the first arm 46, the axis of pivot 44 being positioned parallel to and horizontally below the axis defined by pivot pins 26, 27 of the actuator 24. The actuator 24 includes a cylindrical actuator tube 52 extending downwardly and radially outward from the axis defined by the pivot pins 26, 27 and slideable within the tube is an actuator pin 54 that is urged by a spring 56 radially outward of the axis defined by pins 26, 27 so as to press against the upper surface of the second contact retainer 42.

Figure 5:
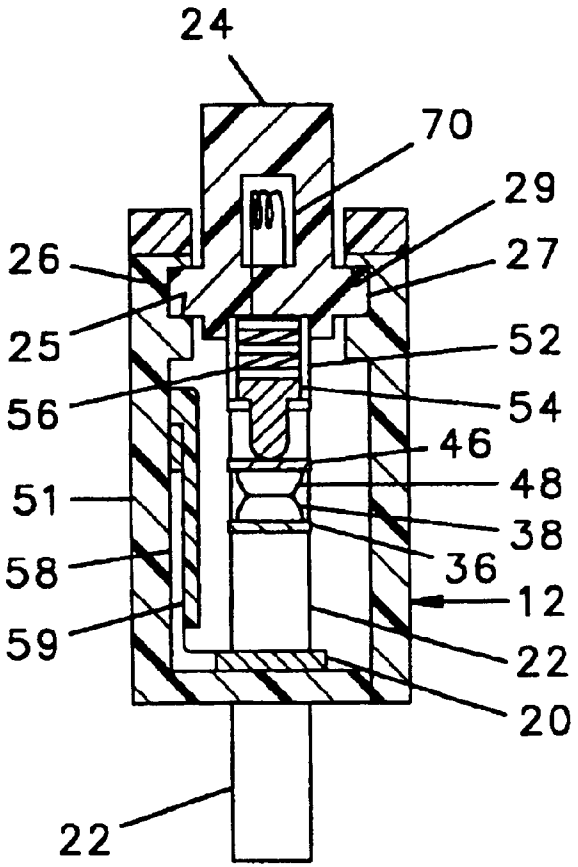
FIG. 5 is a cross-sectional view of the switch of FIG. 1 taken through line 5—5 thereof.

The second connector retainer 42 is electrically connected through the pivot 44 and a shunt 58 extending along the back wall 51 of the housing to the second connector 20 as is best shown in FIG. 5. To prevent arching between the shunt 68 and nearby portions of the first contact retainer 36 and insulating panel 59 may be provided against the surface of the shunt 58 opposite the back wall 51. Movement of the actuator 24 into a first orientation, shown in FIG. 1, while the first contact retainer 36 and first contact 38 are in the first position as shown in FIG. 1, places the first contact 38 and second contact 48 in abutting relationship to each other, closing a circuit connecting the first connector 18 to the second connector 20. Rotation of the actuator 24 around pivot pins 26, 27 moves the actuator pin 54 off the first arm 46 to the second arm 50 will move the second contact 48 from its first orientation shown in FIG. 1 to a second orientation shown in FIG. 3, thereby opening the circuit between the first connector 18 and the second connector 20.

In the event of an overload of current moving through the circuit connecting the first connector 18 to the second connector 20, the bimetal member 30 will become deformed displacing the displaceable portion 32 and drawing the first contact retainer 36 from the orientation shown in FIG. 1 to the orientation shown in FIG. 2 thereby moving the first contact 38 away from the second contact 48 and breaking the circuit between the first connector 18 and the second connector 20. In addition to breaking the circuit between the first and second connectors 18, 20, the movement of the first connector retainer 36 from the first position shown in FIG. 1 to the second position shown in FIG. 2 will draw the hook 40 off of a shoulder 60 on the circuit breaker indicator 28. The circuit breaker indicator 28 has an upper end which extends through an aperture 62 in the housing 12 and a lower end around which is fitted a coil spring 64 which urges the indicator 28 from the retracted position, shown in FIG. 1, to an extended position shown in FIG. 2, upon release of the hook 40 from the shoulder 60. A foot 66 on the indicator 28 engages a second shoulder 68 on the first contact retainer 36 as the indicator 28 moves from the retracted position to the extended position to thereby retain the first contact retainer 36 in the second position as shown in FIG. 2.

In the event of an overload in the circuit connecting the first connector 18 to the second connector 20, the bimetal member 30 will cause the first contact 38 to move away from the second contact 48 while simultaneously releasing the indicator 28 to be urged to the extended position by the coil spring 64. Movement of the indicator to the extended position by the coil spring 64 will further result in the first contact retainer 36 being locked by the foot 66 in the second position as shown in FIG. 3.

After the bimetal member 30 has been allowed to cool, the indicator 28 can be manually depressed. Depressing the indicator 28 move the foot 66 away from the second shoulder 68 and allows the first contact retainer 36 to return to the position shown in FIG. 1 where the hook 40 will again engage the shoulder 60 on the indicator 28. The engagement of the hook 40. on the shoulder 60 will retain the indicator 28 in the retracted position with the coil spring 64 compressed until an excessive current again passes through the bimetal member 30.

The switch 10 further includes a lamp 70 inside the actuator 24 which illuminates the actuator 24 when it is in the "on" position. One connector from the lamp 70 is connected through the coil spring 56, through the electrically conductive actuator pin 54, the second contact retainer 42, the bimetal actuator 30 and the first connector 18. The opposite connector of the lamp 70 is connected through a resistor 72 to one contact 74 of a secondary switch. The second contact 76 of the secondary switch is connected by connecting bus 77 to the third connector 22. Movement of the actuator to the "on" position wherein the second contact 48 is in the first orientation moves contact 74 against contact 76 closing the secondary switch as shown in FIGS. 2 and 3. Moving the activator to the "off" position, wherein the second contact 48 is in the second orientation moves contact 74 away from contact 76 opening the secondary switch, as shown in FIGS. 1 and 4. The lamp 70 will therefore be illuminated when the actuator 24 is rotated to the "on" position, as shown in FIGS. 1 and 4 and will not be illuminated when the actuator 24 is pivoted to the "off" position as shown in FIGS. 2 and 3. If the actuator is in the "on" position but the bimetal actuator has been overloaded, as shown in FIG. 2, the lamp will again not be illuminated because power to the lamp 70 must flow from the first contact 18, through the bimetal actuator 30, the contacts 38, 48 and the pin 54. Opening the contacts 38, 48 therefor breaks the circuit to the lamp 70.

There has therefore been described a switch for electrically switching on and off an appliance where the switch has incorporated therein a circuit breaker for breaking the circuit in the event of an overload of power drawn by the appliance. There is further provided a lamp that is illuminated when the actuator 24 is switched to the "on" position and the bimetal actuator has not been overloaded, and is not illuminated when either (1) the actuator 24 is switched to the "off" position, or (2) the bimetal actuator has been overloaded and the indicator has not been reset.

While the present invention has been described with respect to a single embodiment, it will be appreciated that many modifications and variations may be made without departing from the true spirit and scope of the invention. It is, therefore, the intent of the appended claims to cover all the modifications and variations that fall within the spirit and scope of the invention.

What is claimed is:

1. An electric switch for completing a circuit and having a circuit breaker, said electric switch comprising a manually operable actuator, a first contact, a second contact, said second contact moveable between a first orientation and a second orientation in response to movement of said actuator, a bimetal member having a displaceable portion, a retainer on said displaceable portion, said first contact on said retainer wherein said first contact is moveable from a first position to a second position in response to an electric current above a given threshold passing through said bimetal member, a catch on said retainer spaced from said first contact, an indicator moveable between a position indicative of a broken circuit and a position indicative of a closed circuit, means for urging said indicator toward said position indicative of an opened circuit, and said catch releasably retaining said indicator in said position indicative of a closed circuit.

2. The electric switch of claim 1 and further comprising said actuator having an "on" orientation and an "off" orientation, said second contact moveable between said first orientation and said second orientation in response to movement of said actuator from said "on" orientation to said "off" orientation.

3. The electric switch of claim 2 wherein said first contact is abutting said second contact when said second contact is in said first orientation and said first contact is in said first position.

4. The electric switch of claim 3 and further comprising a first connector electrically connected to said first contact, a second connector electrically connected to said second contact.

5. The electric switch of claim 4 and further comprising a third connector, a lamp in said actuator, and a lamp circuit including a secondary switch, said third connector, and one of said first and said second connectors, wherein said secondary switch is opened when said actuator is in said "off" orientation and closed when said actuator is in said "on" orientation.

6. An electric switch for completing a circuit and having a circuit breaker, said electric switch comprising a manually operable actuator moveable from an "on" position to an "off" position, a first contact moveable between a first position and a second position, a second contact, said second contact moveable between a first orientation and a second orientation in response to movement of said actuator from said "on" position to said "off" position, a bimetal member having a displaceable portion, means for moving said first contact from said first position to said second position in response to an electric current above a given threshold passing through said bimetal member wherein said first contact is abutting said second contact when said second contact is in said first orientation and said first contact is in said first position and spaced from said second contact when said first contact is in said second position and said second contact is in said first orientation and said manually operated actuator remains in said on position.

7. An electric switch for completing a circuit and having a circuit breaker, said electric switch comprising a manually operable actuator, a first contact moveable between a first position and a second position, a second contact, said second contact moveable between a first orientation and a second orientation in response to movement of said actuator, a bimetal member having a displaceable portion, means for moving said first contact from a first position to a second position in response to an electric current above a given threshold passing through said bimetal member wherein said first contact is abutting said second contact when said second contact is in said first orientation and said first contact is in said first position and spaced from said second contact when said first contact is in said second position, an indicator moveable between an extended position indicative of a broken circuit and a retracted position indicative of a closed circuit, means for urging said indicator toward said extended position, a catch for releasably retaining said indicator in said retracted position, means on said indicator for retaining said second contact in said second position while said indicator is in said extended position, and means for releasing said catch in response to movement of said first contact to said second position.

8. The electric switch of claim 7 and further comprising a first connector electrically connected to said first contact, a second connector electrically connected to said second contact, a third connector, a lamp in said actuator, a lamp circuit including a secondary switch, said third connector, and one of said first and said second connectors wherein said secondary switch is opened on movement of said actuator causing said second contact to move to said second orientation and is closed on movement of said actuator causing said second contact to move to said first orientation.

9. An electric switch for completing a circuit and having a circuit breaker, said electric switch comprising a manually operable actuator moveable between an "on" orientation and an "off" orientation, a first connector, a bimetal member having a base and a displaceable portion, said base of said bimetal member connected to said first connector, a first contact connected to said displaceable portion wherein said first contact is moveable between a first position and a second position in response to the displacement of said of said displaceable portion, a second contact, said second contact moveable between a first orientation and a second orientation in response to movement of said actuator from said "on" orientation to said "off" orientation, a second connector connected to said second contact, said first contact abutting said second contact when said second contact is in said first orientation and said first contact is in said first position and spaced from said second contact when said first contact is in said second position, an indicator moveable between an extended position indicative of a broken circuit and a retracted position indicative of a closed circuit, means for urging said indicator toward said extended position, a catch attached to said displaceable portion, said catch for retaining said indicator in said retracted position and for releasing said indicator for movement to said extended position upon movement of said displaceable portion, and means on said indicator for retaining said second contact in said second position while said indicator is in said extended position.

* * * * *

UNITED STATES PATENT AND TRADEMARK OFFICE

CERTIFICATE OF CORRECTION

PATENT NO. : 6,741,157 B2
DATED : May 25, 2004
INVENTOR(S) : Jack Chen

It is certified that error appears in the above-identified patent and that said Letters Patent is hereby corrected as shown below:

Column 3,
Line 52, after “retainer 36” delete “and” substitute -- an --.

Column 6,
Line 23, after “said,” delete “on” and substitute -- on --.

Column 7,
Line 17, after “displacement” delete the first recitation of “of said”.

Signed and Sealed this

Eleventh Day of January, 2005

JON W. DUDAS
*Director of the United States Patent and Trademark Office*